US007216947B2

(12) United States Patent
Kusunoki

(10) Patent No.: US 7,216,947 B2
(45) Date of Patent: May 15, 2007

(54) IMAGE FORMING APPARATUS AND DROPLET EJECTION CONTROL METHOD

(75) Inventor: Naoki Kusunoki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 359 days.

(21) Appl. No.: 10/947,232

(22) Filed: Sep. 23, 2004

(65) Prior Publication Data

US 2005/0062774 A1 Mar. 24, 2005

(30) Foreign Application Priority Data

Sep. 24, 2003 (JP) ..... 2003-332464

(51) Int. Cl.
*B41J 29/38* (2006.01)

(52) U.S. Cl. ..... 347/9; 347/10; 347/14

(58) Field of Classification Search ..... 347/9
See application file for complete search history.

(56) References Cited

U.S. PATENT DOCUMENTS

| | | | | |
|---|---|---|---|---|
| 4,965,593 | A | 10/1990 | Hickman | |
| 5,608,439 | A | 3/1997 | Arbeiter et al. | |
| 5,923,348 | A | 7/1999 | Cunnagin et al. | |
| 6,172,689 | B1 | 1/2001 | Cunnagin et al. | |
| 6,312,081 | B1 | 11/2001 | Ohtsu | |
| 6,527,354 | B2 * | 3/2003 | Takahashi | 347/9 |
| 2003/0038851 | A1 | 2/2003 | Oriol | |

FOREIGN PATENT DOCUMENTS

| | | | |
|---|---|---|---|
| JP | 3-247450 | A | 11/1991 |
| JP | 10-250059 | A | 9/1998 |
| JP | 2000-229425 | A | 8/2000 |
| JP | 2003-211640 | A | 7/2003 |

* cited by examiner

*Primary Examiner*—Manish S. Shah
*Assistant Examiner*—Brian J. Goldberg
(74) *Attorney, Agent, or Firm*—Birch, Stewart, Kolasch & Birch, LLP

(57) ABSTRACT

The image forming apparatus comprises: a recording head which ejects droplets of a liquid onto a recording medium; a droplet ejection control device which controls a droplet ejection timing of the recording head; and a conveyance device which relatively moves the recording medium and the recording head in a relative conveyance direction, wherein when the recording head performs ejection of a first droplet to form a first dot on the recording medium and then performs ejection of a second droplet to form a second dot overlapping with the first dot on the recording medium, the droplet ejection control device controls the droplet ejection timing of the recording head by taking a droplet diameter change time until a diameter of the first droplet deposited on a surface of the recording medium reaches D1*b* satisfying the following inequality as a droplet ejection time interval between the ejection of the first droplet and the ejection of the second droplet: $D1b<2\times Pt-D2a$, where Pt is an interval between the first dot and the second dot on the surface of the recording medium, D2*a* is a diameter of the second droplet upon landing on the surface of the recording medium, and D1*b* is the diameter of the first droplet on the surface of the recording medium when the second droplet lands on the surface of the recording medium.

11 Claims, 13 Drawing Sheets

IMAGE FORMING APPARATUS AND DROPLET EJECTION CONTROL METHOD

This Non-provisional application claims priority under 35 U.S.C. § 119(a) on Patent Application No(s). 2003-332464 filed in Japan on Sep. 24, 2003, the entire contents of which are hereby incorporated by reference.

BACKGROUND OF THE INVENTION

1. Field of the Invention

The present invention relates to an image forming apparatus and a droplet ejection control method, and more particularly to a recording control technology for an image forming apparatus for forming images by means of dots formed on a recording medium.

2. Description of the Related Art

Recently, inkjet recording apparatuses (inkjet printers) have become common as recording apparatuses for printing and recording images captured by digital still cameras, and the like. An inkjet recording apparatus comprises a plurality of recording elements (nozzles) in a head, the recording head being move to scan a recording medium while droplets of ink are ejected onto the recording medium from the recording elements, the recording medium being conveyed through a distance corresponding to one line, each time one line of an image is recorded onto a recording medium, and an image being formed onto the recording paper by repeating this process.

Inkjet printers include those which use a fixed-length serial head, and carry out recording by moving the head in the lateral direction of a recording medium, and those which use a line head in which recording elements are arranged over a length corresponding to the full dimension of one edge of the recording medium. In a printer using a line head, it is possible to record an image across the entire surface of the recording medium, by scanning the recording medium in an orthogonal direction to the direction in which the recording elements are arranged. In a printer using a line head, it is not necessary to provide a conveyance system, such as a carriage, for moving a short-dimension head, nor is it necessary to move a carriage, or perform complicated scanning control of the recording medium. Furthermore, since only the recording medium is moved, it is possible to increase the recording speed in comparison to printers using serial heads.

In an inkjet printer, one image is represented by combining dots formed by ink ejected from recording elements (nozzles). High image quality can be achieved by making the dots small in size and by using a large number of pixels per image. Small dot size can be achieved by reducing the amount of ink ejected, and therefore it is necessary to control the ink ejection volume finely and accurately. The relative speed of the recording medium and the recording head, and the ink ejection timing, are controlled in such a manner that adjacently positioned dots are deposited at prescribed positions.

Japanese Patent Application Publication No. 3-247450 discloses an inkjet recording apparatus and proposes a technology for calculating printing times for avoiding image distortion, according to the ink absorption characteristics, ink permeability, ink (dot) density, ink volume, ink evaporation characteristics, and ambient temperature. In other words, the drying time of the ink, and the like, is estimated from the aforementioned parameters, and the interval between one recording operation and the next is adjusted accordingly.

Furthermore, Japanese Patent Application Publication No. 10-250059 discloses a method of manufacturing a recording head for an inkjet printer, and a printing method; more specifically, a method of manufacturing a print head in which the distance between nozzles is determined in accordance with the ink drying time, and a print method using this print head.

However, if a plurality of dots are ejected so as to land in an overlapping manner on a recording medium, the ink droplets combine, the original circular shape of the dots are lost, and hence it becomes difficult to form the desired image.

In the inkjet recording apparatus disclosed in Japanese Patent Application Publication No. 3-247450, the time for avoiding image distortion is determined for each parameter, but it is extremely difficult to determine a time for avoiding image distortion in relation to various types of dot patterns. Furthermore, no sufficient explanation of the recording method is given in cases where mixed patterns combining different dot pitches and dot sizes are formed in one image.

In the method for manufacturing a recording head for an inkjet printer and the printing method disclosed in Japanese Patent Application Publication No. 10-250059, it is stated that a second dot is ejected so as to land after the drying time for a first dot has elapsed. However, since an adjacent dot cannot be deposited onto the paper until the existing dot on the surface of the paper has dried completely, then printing takes an extremely long time. Furthermore, since the distance between the nozzles is determined by estimating the drying time based on one set of conditions, and since this is a fixed value, it is not possible to respond to cases where different ink or paper is used.

SUMMARY OF THE INVENTION

The present invention is contrived in view of such circumstances, and an object thereof is to provide an image forming apparatus and a droplet ejection control method whereby image distortion caused by superimposition of dots is prevented, without increasing the recording time.

In order to attain the above-described object, the present invention is directed to an image forming apparatus, comprising: a recording head which ejects droplets of a liquid onto a recording medium; a droplet ejection control device which controls a droplet ejection timing of the recording head; and a conveyance device which relatively moves the recording medium and the recording head in a relative conveyance direction, wherein when the recording head performs ejection of a first droplet to form a first dot on the recording medium and then performs ejection of a second droplet to form a second dot overlapping with the first dot on the recording medium, the droplet ejection control device controls the droplet ejection timing of the recording head by taking a droplet diameter change time until a diameter of the first droplet deposited on a surface of the recording medium reaches D1*b* satisfying the following inequality as a droplet ejection time interval between the ejection of the first droplet and the ejection of the second droplet: $D1b<2\times Pt-D2a$, where Pt is an interval between the first dot and the second dot on the surface of the recording medium, D2*a* is a diameter of the second droplet upon landing on the surface of the recording medium, and D1*b* is the diameter of the first droplet on the surface of the recording medium when the second droplet lands on the surface of the recording medium.

According to the present invention, even if a second droplet is ejected so as to land on the recording medium without waiting for the first droplet, which landed previously on the recording medium, to be retained completely in the recording medium, there is still no combining of the ink droplets on the surface of the recording medium. Therefore, blurring caused by mixing of the first droplet and the second droplet can be prevented, and a desired dot shape can be obtained, without reducing the printing speed.

For example, as a droplet proceeds to permeate into the recording medium, the droplet reduces in size at the surface of the recording medium, from the outer side (outer circumference) toward the inner side. The size of the dot formed by the droplet is substantially the same as the size of the droplet when it lands on the recording medium.

The interval between the first dot and the second dot (namely, the dot pitch) Pt is substantially the same as the interval between the droplets when ejected (recorded) normally from the recording head.

Furthermore, if the first droplet has permeated completely, solidified completely, or the like, then D1*b* will be zero. Therefore, a state where the first ink droplet has not yet permeated completely is indicated by the expression D1*b*>0.

If the first dot and the second dot are overlapping, then the total of the radius of the first dot (D1*a*/2) and the radius of the second dot (D2*a*/2) is greater than the distance Pt between the first dot and the second dot. This state is indicated by the relationship Pt<(D1*a*/2)+(D2*a*/2).

The recording head may be a full line type recording head in which recording elements, such as ink ejecting holes, are arranged over a length corresponding to the full dimension of the printable region of the recording medium, in a direction substantially orthogonal to the relative conveyance direction of the conveyance device. The recording head may also be a serial type (shuttle scan type) recording head in which ink droplets are ejected from a recording head of short dimensions, while the head is moved in a direction substantially orthogonal to the relative conveyance direction of the conveyance device.

Moreover, "recording medium" indicates a medium (an image forming medium) which receives printing by means of a recording head, and more specifically, this term includes various types of media, irrespective of material and size, such as continuous paper, cut paper, sealed paper, resin sheets, such as OHP sheets, film, cloth, and other materials.

In order to achieve relative movement between the recording medium and the recording head, it is possible to move the recording medium with respect to a fixed recording head, or to move the recording head with respect to a fixed recording medium. Alternatively, it is also possible to move both the recording medium and the recording head. A conveyance belt, conveyance drum, or the like, can be used as a conveyance device for the recording medium.

Preferably, the image forming apparatus further comprises: a droplet ejection condition calculating device which determines the diameter D1*b* of the first droplet satisfying the inequality: D1*b*<2×Pt−D2*a*, with respect to the interval Pt between the first dot and the second dot on the surface of the recording medium, and the diameter D2*a* of the second droplet upon landing on the surface of the recording medium; and a droplet diameter change time calculating device which determines the droplet diameter change time from a time at which the first droplet lands on the surface of the recording medium until the diameter of the first droplet on the surface of the recording medium reaches D1*b*.

According to the present invention, since the image forming apparatus comprises the droplet ejection condition calculating device which determines the condition of the first droplet at which the second droplet can be deposited, and the droplet diameter change time calculating device which determines the time until the first droplet satisfies this condition, then the droplet ejection time interval can be determined inside the apparatus.

Preferably, when a mixed pattern including a plurality of combinations of the interval between the first dot and the second dot, the first dot diameter and the second dot diameter, is to be formed within one image on the recording medium, the droplet diameter change time calculating device calculates a plurality of values for the droplet diameter change time, and the droplet ejection control device controls a recording timing for the image by using a representative value of the plurality of droplet ejection diameter change time values. According to this, even to images comprising mixed patterns of varying dot intervals (dot pitches), and varying dot sizes are acceptable. Therefore, the droplet ejection timing can be optimized for each image.

Mixed patterns may comprise a plurality of dot intervals, or a plurality of dot sizes, or they may comprise both a plurality of dot intervals and a plurality of dot sizes. Any of these cases is acceptable.

The representative value may be the maximum value, minimum value, average value, the most frequently used value, or the like. The most suitable type of representative value is preferably chosen according to the image quality and recording control conditions. It is possible to use either one representative value per image, or a plurality of representative values per image.

Preferably, the representative value of the droplet diameter change time includes at least a value not less than a maximum value of the plurality of droplet diameter change time values calculated by the droplet diameter change time calculating device. According to this, since the droplet ejection timing within an image is controlled in accordance with the pattern having the longest droplet diameter change time, then blurring of dots can be prevented reliably, while simplifying the related control operation and hence reducing the burden on the control system.

The droplet diameter change time may be the maximum value determined from the respective patterns, or it may be a time incorporating a safety margin in addition to the maximum value. However, the droplet diameter change time is less than the time taken for the droplet to permeate or solidify completely.

Preferably, the image forming apparatus further comprises: an information supply device which supplies information containing at least one of information relating to a type of the liquid and information relating to a type of the recording medium, wherein the droplet diameter change time calculating device calculates the droplet diameter change time according to the information supplied by the information supply device. According to this, even if the type of the liquid or the type of the recording medium (recording paper) is changed, optimal droplet ejection timing is used to perform recording (image formation). Therefore, not only is a fast printing speed achieved, but also, the desired dot shape can be obtained.

In addition to the ink type and the recording medium type, the aforementioned information may also include other factors which affect the permeation rate of the ink, such as the temperature, humidity, or other environmental conditions. Desirably, these conditions are stored as a data table, in such a manner that the data table can be referred to each time the droplet diameter change time is determined.

Preferably, the droplet diameter change time calculating device determines a first droplet diameter change time in a main scanning direction substantially orthogonal to the relative conveyance direction, and a second droplet diameter change time in a sub-scanning direction being the relative conveyance direction, according to the interval between the first dot and the second dot in the main scanning direction, and the interval between the first dot and the second dot in the sub-scanning direction; and the droplet ejection control device controls the droplet ejection timing by taking the first droplet diameter change time and the second droplet diameter change time as a droplet ejection time interval in the main scanning direction and a droplet ejection time interval in the sub-scanning direction, respectively. According to this, the droplet ejection timing can be controlled respectively in the direction substantially orthogonal to the relative conveyance direction of the conveyance device (namely, the main scanning direction), and in the relative conveyance direction of the conveyance device (namely, the sub-scanning direction).

Preferably, the droplet ejection control device controls the droplet ejection timing by means of one droplet ejection time interval within one image. According to this, since droplet ejection control is carried out using one droplet ejection interval within one image, then one droplet ejection interval can be determined for each image.

For example, the recording head is a line head in which a plurality of nozzles are arranged over a length corresponding to a full width of the recording medium. The line head may be a divided head which is divided into a plurality of heads in the longitudinal direction of the head. Furthermore, the head may be provided with one row of nozzles, or a plurality of rows of nozzles. Preferably in this case, the recording head comprises a first nozzle row having nozzles for ejecting droplets forming odd-numbered dots of dots formed in a direction substantially orthogonal to the relative conveyance direction, and a second nozzle row having nozzles for ejecting droplets forming even-numbered dots of the dots; and the image forming apparatus further comprises an interval changing device which changes an interval between the first nozzle row and the second nozzle row according to the droplet ejection control in the relative conveyance direction. According to this, the recording timing in the direction substantially orthogonal to the recording medium can be controlled efficiently in the line head.

Alternatively, it is possible that the recording head is a serial head in which a plurality of nozzles are arranged over a length shorter than a full width of the recording medium, and the recording head comprises a moving device which relatively moves the recording head and the recording medium in a direction in which the plurality of nozzles are arranged. Preferably in this case, the recording head comprises a first nozzle row having nozzles for ejecting droplets forming odd-numbered dots of dots formed in a direction substantially orthogonal to the relative conveyance direction, and a second nozzle row having nozzles for ejecting droplets forming even-numbered dots of the dots; and the image forming apparatus further comprises an interval changing device which changes an interval between the first nozzle row and the second nozzle row according to the droplet ejection control in the direction substantially orthogonal to the relative conveyance direction. According to this, it is possible to control the recording timing in the direction substantially orthogonal to the recording medium, without altering the conveyance speed or the recording frequency.

Furthermore, the present invention also provides a method for attaining the above-described object. More specifically, the present invention is directed to a droplet ejection control method for an image forming apparatus comprising: a recording head which ejects droplets of a liquid onto a recording medium; and a droplet ejection control device which controls a droplet ejection timing of the recording head, the method comprising: a first droplet ejecting step of ejecting a first droplet to form a first dot on the recording medium; a second droplet ejecting step of ejecting a second droplet to form a second dot overlapping with the first dot on the recording medium, after the first droplet ejecting step; a droplet ejection condition calculating step of determining a diameter of the first droplet deposited on a surface of the recording medium so that the first droplet and the second droplet do not overlap on the surface of the recording medium, when the second droplet is ejected; and a droplet diameter change time calculating step of determining a time required for the diameter of the first droplet deposited on the surface of the recording medium to change from its value upon landing on the surface of the recording medium, to a value at which the first droplet does not overlap with the second droplet on the surface of the recording medium.

Software (a program) for achieving the aforementioned steps may be created, and this program may be implemented by means of a control device, such as a CPU (central processing unit). Furthermore, the program may also be stored on a recording medium, or distributed through a network.

According to the present invention, even if a second ink droplet is ejected without waiting for a first ink droplet, ejected previously, to permeate completely, the first ink droplet and the second ink droplet do not combine on the recording medium. Therefore, the desired dot shape can be obtained. Furthermore, since the second ink droplet can be ejected without waiting for the first ink droplet to permeate completely, then the printing speed can be fast.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
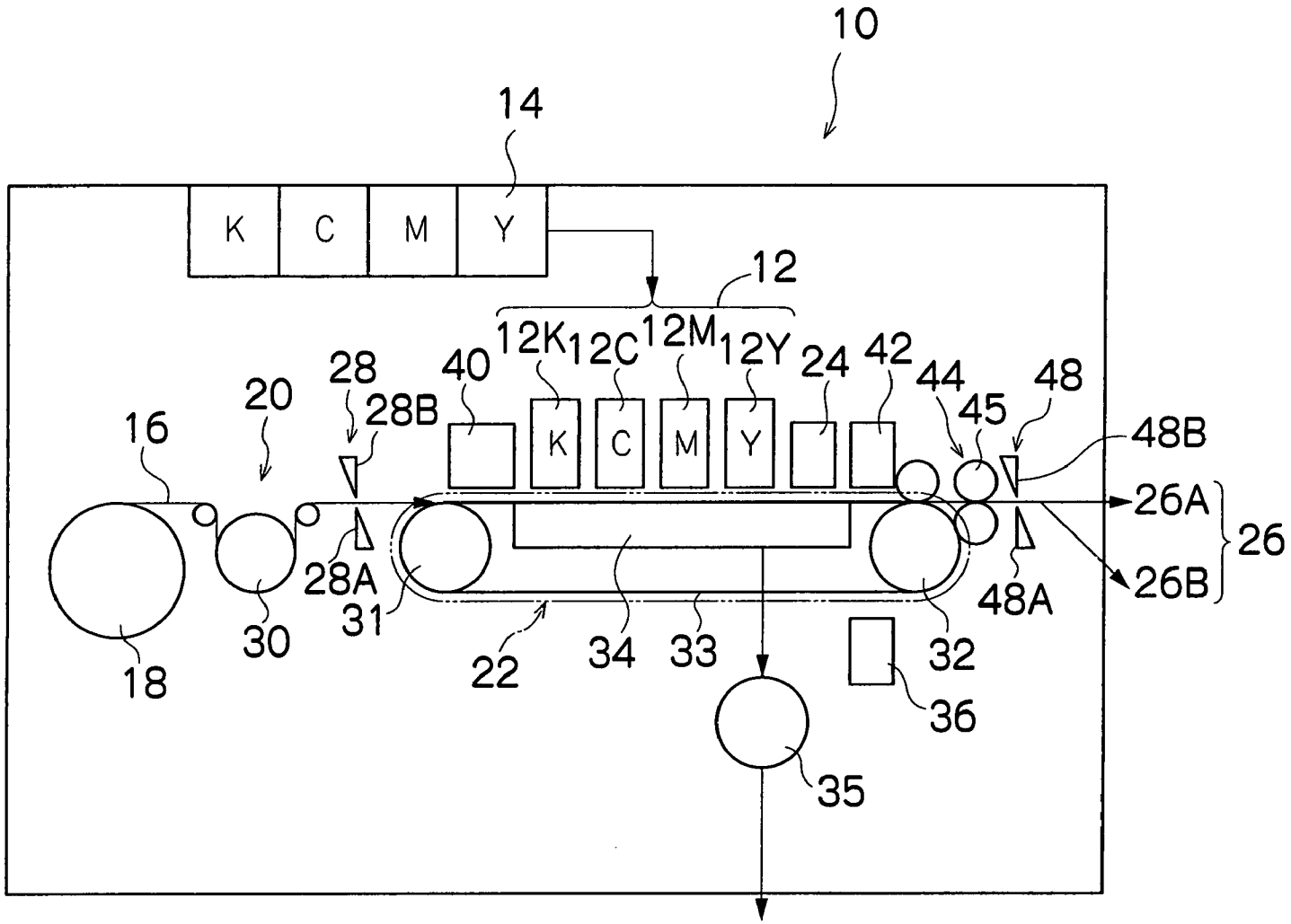
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 88 in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
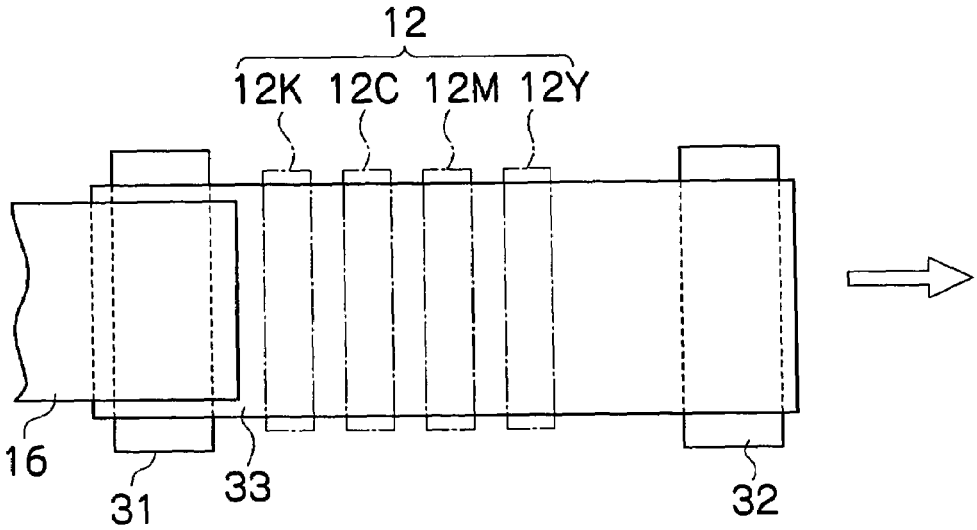
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
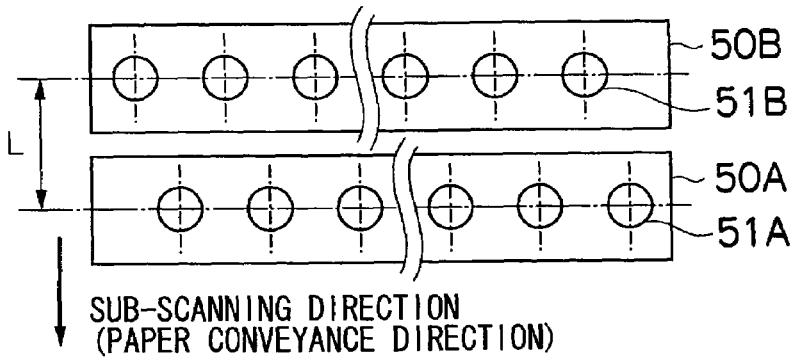
FIG. 3A is a perspective plan view showing an example of a configuration of a print head.
Figure 3B:
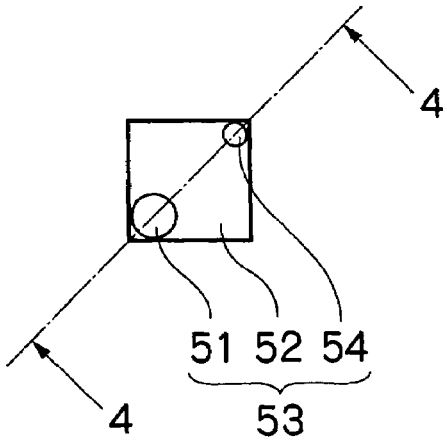
FIG. 3B is a partial enlarged view of FIG. 3A.
Figure 3C:
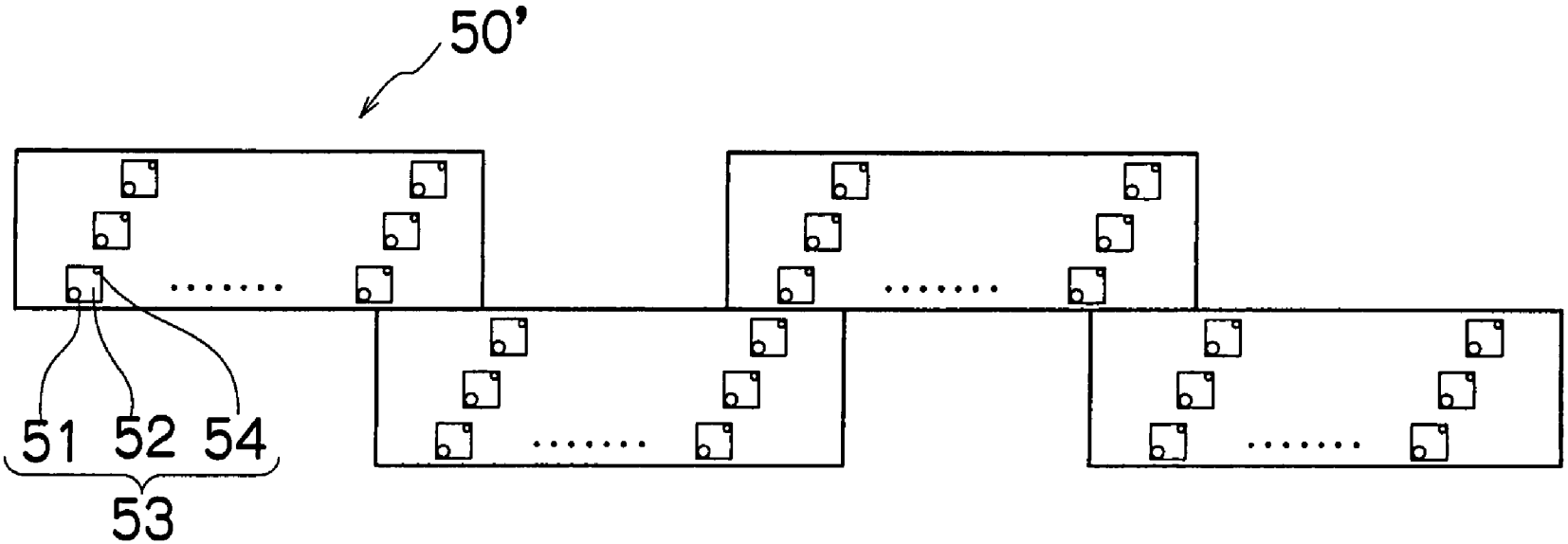
FIG. 3C is a perspective plan view showing another example of the configuration of the print head.
Figure 4:
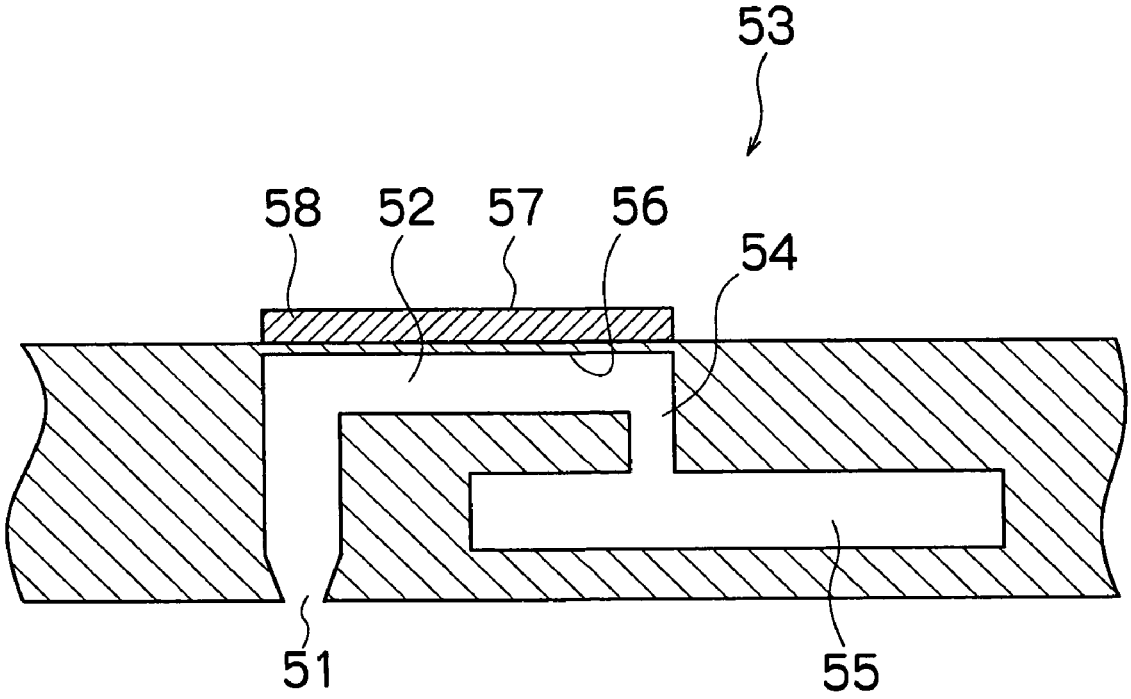
FIG. 4 is a cross-sectional view along the line 4—4 in FIG. 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4—4 in FIG. 3B, showing the inner structure of an ink chamber unit.

The print head 50 of the present embodiment includes print heads 50A and 50B, which are movable relatively to each other along the paper conveyance direction so as to change the distance between the print heads 50A and 50B (i.e., the nozzle pitch along the paper conveyance direction).

For example, a configuration is possible where the print head 50A is provided with a head moving mechanism (not shown) including a carriage mechanism such as a motor, a ball screw, a slide rail, and a guide member, and the print head 50A is movable relatively to the stationary print head 50B. Another configuration is also possible where both the print heads 50A and 50B are provided with the above-described head moving mechanisms and are movable. It is also possible that the print head 50A is fixed and the print head 50B is movable.

As shown in FIG. 3A, each of the print heads 50A and 50B has a single row of a plurality of nozzles in the direction substantially perpendicular to the paper conveyance direction. The interval (nozzle pitch) of nozzles 51A arranged in the print head 50A is equal to the nozzle pitch of nozzles 51B arranged in the print head 50B.

The print heads 50A and 50B are positioned relatively to each other in the direction substantially perpendicular to the paper conveyance direction so that the nozzle 51B of the print head 50B is positioned at a substantially halfway point between the adjacent nozzles 51A of the print head 50A.

In other words, the nozzles 51A of the print head 50A and the nozzles 51B of the print head 50B are arranged with deviation of a half pitch from each other in the form of a staggered matrix. This is equivalent to the arrangement where nozzles are arranged with a half pitch of the nozzles in the print head 50 along a line in the direction substantially perpendicular to the paper conveyance direction.

Each of the print heads 50A and 50B has the single row of nozzles in the above-described embodiment; however, each of the print heads may have nozzles arranged two-dimensionally in a matrix.

Alternatively, as shown in FIG. 3C, it is possible to arrange and combine a plurality of short-length head units 50', each of which has nozzles two-dimensionally arranged, in the form of a staggered matrix so as to form nozzle rows having lengths that correspond to the entire width of the recording medium.

The planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel 55 through the supply port 54. The common channel 55 is connected to an ink supply tank, which is a base tank that supplies ink, and the ink supplied from the ink tank is delivered through the common flow channel 55 to the pressure chamber 52. It is preferable to provide a sub-tank (not shown) between the ink tank and the common flow channel 55 nearby the print head 12 or integrally to the print head 12. The sub-tank has a damper function for preventing variation in the internal pressure of the head and a function for improving refilling of the print head.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 3A are driven, the main scanning according to the above-described (3) is preferred. More specifically, one line is printed in the width direction of the recording paper 16 by driving the nozzles 51A and 51B at different timing such as by sequentially driving the nozzles 51A, 51B, 51A, . . . in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this, and other actuators can be used.

Figure 5:
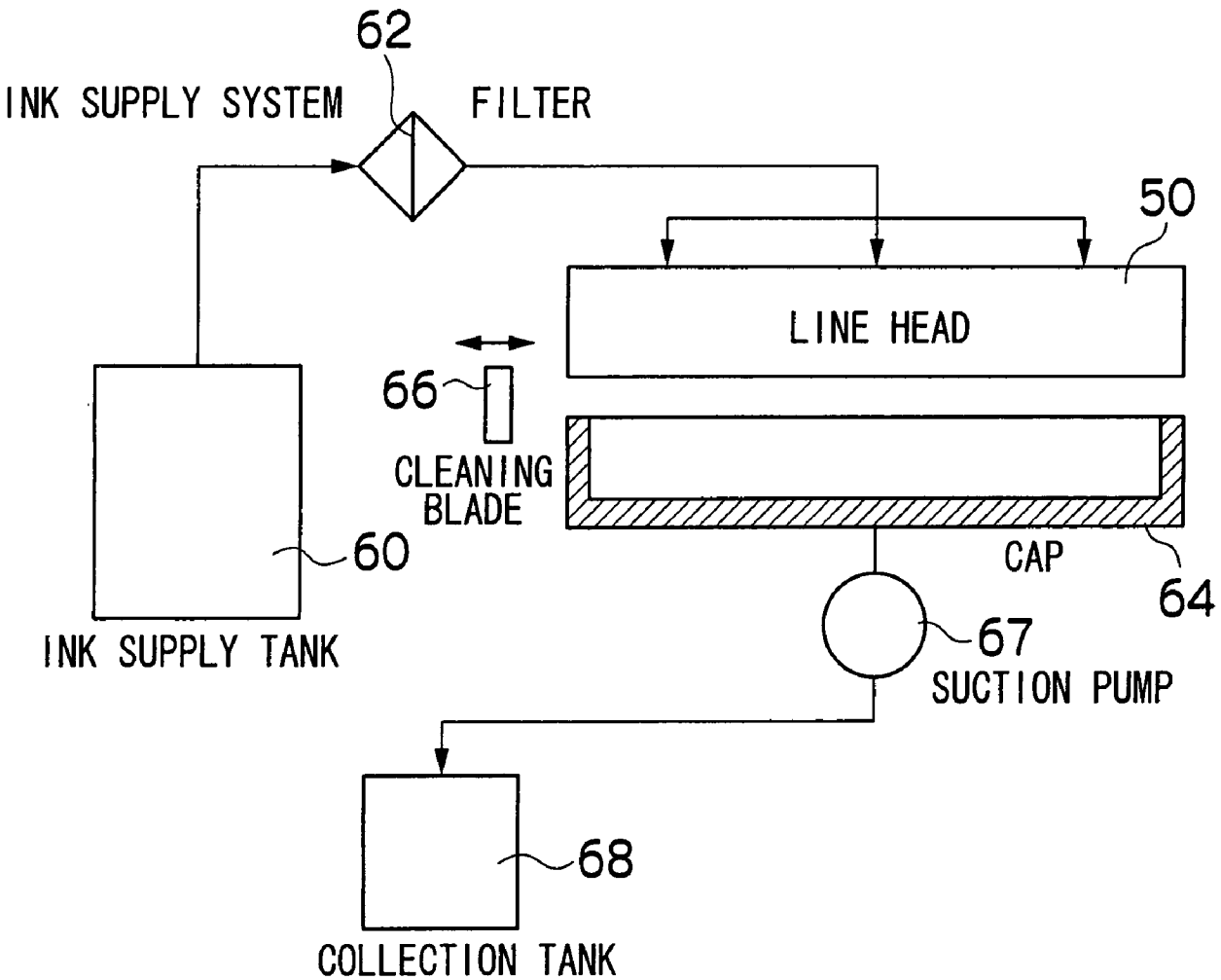
FIG. 5 is a schematic drawing showing a configuration of an ink supply system in the inkjet recording apparatus.

FIG. 5 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 5 is equivalent to the ink storing/loading unit 14 in FIG. 1 described above.

A filter 62 for removing foreign matters and bubbles is disposed between the ink supply tank 60 and the print head 50, as shown in FIG. 5. The filter mesh size in the filter 62 is preferably equivalent to or less than the diameter of the nozzle and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzle 51 from drying out or to prevent an increase in the ink viscosity in the vicinity of the nozzles, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the ink discharge face of the nozzle 51 is thereby covered with the cap 64.

During printing or standby, when the frequency of use of specific nozzles 51 is reduced and a state in which ink is not discharged continues for a certain amount of time or longer, the ink solvent in the vicinity of the nozzle evaporates and ink viscosity increases. In such a state, ink can no longer be discharged from the nozzle 51 even if the actuator 58 is operated.

Before reaching such a state the actuator 58 is operated (in a viscosity range that allows discharge by the operation of the actuator 58), and a preliminary discharge (purge, air discharge, liquid discharge, dummy discharge) is made toward the cap 64 (ink receptor) to which the degraded ink (ink whose viscosity has increased in the vicinity of the nozzle) is to be discharged.

Also, when bubbles have become intermixed in the ink inside the print head 50 (inside the pressure chamber 52), ink can no longer be discharged from the nozzle even if the actuator 58 is operated. The cap 64 is placed on the print head 50 in such a case, ink (ink in which bubbles have become intermixed) inside the pressure chamber 52 is removed by suction with a suction pump 67, and the suction-removed ink is sent to a collection tank 68.

This suction action entails the suctioning of degraded ink whose viscosity has increased (hardened) when initially loaded into the head, or when service has started after a long period of being stopped. The suction action is performed with respect to all the ink in the pressure chamber 52, so the amount of ink consumption is considerable. Therefore, a preferred aspect is one in which a preliminary discharge is performed when the increase in the viscosity of the ink is small.

The cleaning blade 66 is composed of rubber or another elastic member, and can slide on the ink discharge surface (surface of the nozzle plate) of the print head 50 by means of a blade movement mechanism (wiper, not shown). When ink droplets or foreign matter has adhered to the nozzle plate, the surface of the nozzle plate is wiped, and the surface of the nozzle plate is cleaned by sliding the cleaning blade 66 on the nozzle plate. When the unwanted matter on the ink discharge surface is cleaned by the blade mechanism, a preliminary discharge is carried out in order to prevent the foreign matter from becoming mixed inside the nozzles 51 by the blade.

Figure 6:
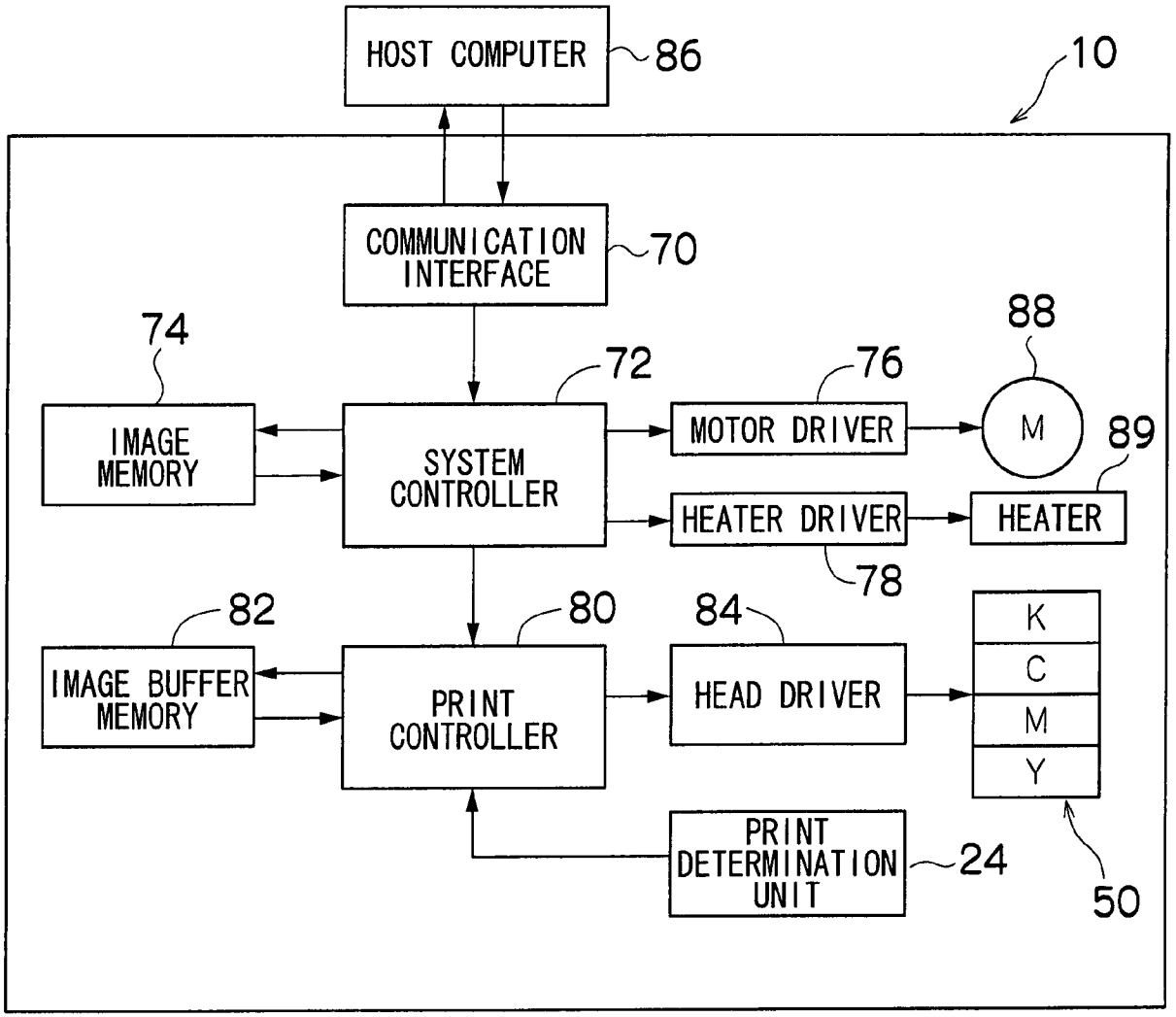
FIG. 6 is a block diagram of principal components showing a system configuration of the inkjet recording apparatus.

FIG. 6 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 according to the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors according to the print data received from the print controller 80. A feedback control system for keeping the drive conditions for the print heads constant may be included in the head driver 84.

Control of Droplet Ejection Timing

The control of droplet ejection timing (droplet ejection control) in the inkjet recording apparatus 10 is now described with reference to FIGS. 7 to 12. In the inkjet recording apparatus 10, in cases where dots formed onto the recording paper 16 are mutually overlapping, the droplet ejection (recording) timing is controlled in such a manner that a succeeding ink droplet 110 (see FIG. 9) is ejected, before a previously ejected (or "preceding") ink droplet 100 has permeated completely into the recording paper 16.

Figure 7:
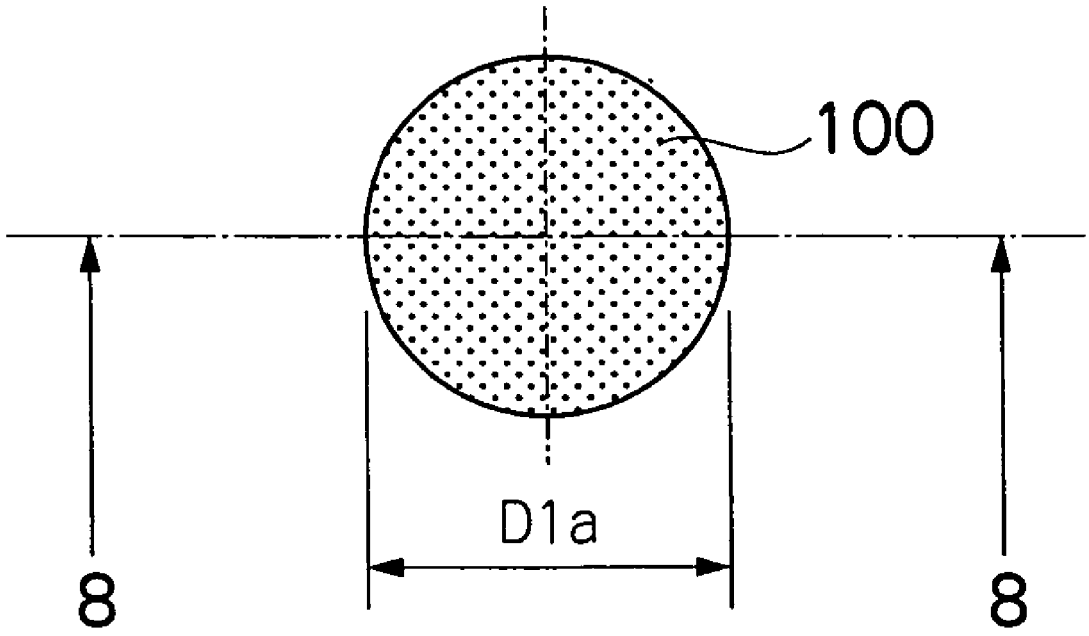
FIG. 7 is a diagram describing droplet ejection control in an inkjet recording apparatus relating to an embodiment of the present invention.

FIG. 7 shows the preceding ink droplet 100, which is ejected first. The diameter of the ink droplet 100 on the surface of the recording paper 16 is D1*a*.

If a dye based ink is deposited on the recording paper 16 (recording medium) to which ink is permeable, when the ink droplet 100 lands on the surface of the recording paper 16, it permeates into the image receiving layer (not illustrated) of the recording paper 16 as time passes. This permeation is completed from the outer side toward the inner side of the ink droplet 100, and hence the diameter of the ink droplet gradually decreases toward the center.

When a prescribed time period T has passed, the solvent on the surface of the recording paper 16 has disappeared and the ink droplet 100 has permeated completed into the recording paper 16. Here, a dot of a prescribed size is formed. In the present embodiment, the dot is taken to have the same diameter as the diameter of the ink droplet when it lands on the paper. This time period T is taken to be the complete permeation time.

Figure 8:
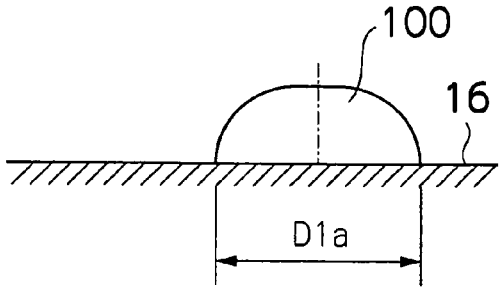
FIG. 8 is a cross-sectional view along the line 8—8 in FIG. 7.

FIG. 8 is a cross-sectional diagram along line 8—8 in FIG. 7, and shows a state immediately after the ink droplet 100 has landed on the recording paper 16.

Figure 9:
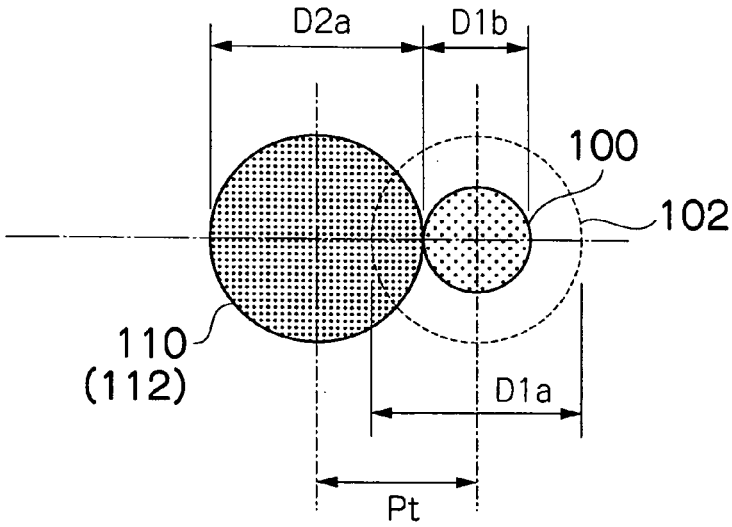
FIG. 9 is a diagram for describing the principal part of the droplet ejection control illustrated in FIG. 7.

FIG. 9 shows a state where a prescribed time period, which is less than the complete permeation time T, has elapsed since the ink droplet 100 landed on the recording paper 16. In this state, the diameter of the ink droplet 100 on the surface of the recording paper 16 has become D1*b*.

The circle indicated by the dashed line in FIG. 9 shows the dot 102 that is formed by the ink droplet 100, and the size of the dot 102 is approximately the same as that of the ink droplet 100 upon landing on the recording paper 16. More specifically, the dot 102 having the diameter of D1*a* is formed by the ink droplet 100.

Furthermore, FIG. 9 shows a state where an ink droplet 110 of diameter D2*a* has been deposited to form a dot 112 having a dot diameter of D2*a*, at an interval (dot pitch) of Pt from the dot 102.

If the following condition (Formula 1) is satisfied by the relationship between the diameter D1*b* of the preceding ink droplet 100 when a time δT has elapsed since it landed on the recording paper 16, the diameter D2*a* of the ink droplet 110 upon landing on the recording paper 16, and the interval Pt between the ink droplet 100 and the ink droplet 110 (which is equivalent to the pitch between the dots formed by the ink droplet 100 and the ink droplet 110):

$$D1b<2\times Pt-D2a, \quad (1)$$

then the ink droplet 100 and the ink droplet 110 do not combine on the surface of the recording paper 16. Therefore, the shapes of the dot 102 and the dot 112 formed respectively by the ink droplet 100 and the ink droplet 110 are not disturbed. In FIG. 9, the dot 112 is formed at the same position and to the same size as the ink droplet 110. In this way, the desired dot shape can be achieved.

Here, the condition indicating overlap between the dots 102 and 112 is expressed by Pt<(D1*a*/2)+(D2*a*/2). In other words, the condition for overlapping between the dots 102 and 112 is that the total of the radius of the dot 102 plus the radius of the dot 112 be greater than the dot pitch Pt.

The dot 102 shown in FIG. 9 comprises a region where the ink droplet 100 has not permeated into the recording paper 16 (the region illustrated as the ink droplet 100), and a region where the ink droplet 100 has permeated completely into the recording paper 16 and the coloring material (solute) of the ink is held within the image receiving layer of the recording paper 16 (the region of the dot 102 indicated by the dashed line excluding the region indicated by the ink droplet 100). Out of these two regions of the dot 102, it is possible to deposit another ink droplet 110 so as to land on the region where the ink droplet 100 has permeated completely into the recording paper 16.

Figure 10:
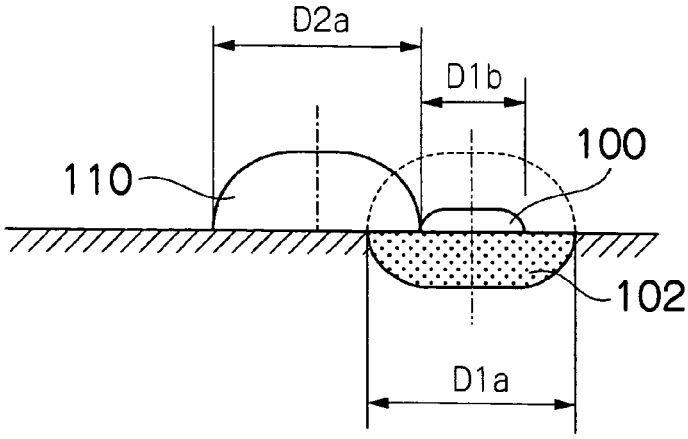
FIG. 10 is a cross-sectional view of FIG. 9.

FIG. 10 is a cross-sectional diagram showing a cross-section of the ink droplet 100 and the ink droplet 110, and corresponds to FIG. 8. As the ink droplet 110 permeates into the recording paper 16, the ink droplet 100 and the ink droplet 110 may combine in the image receiving layer of the recording paper 16 in the region of overlap between the dot 102 and the ink droplet 110. However, even if combining of the droplets occurs in this way, since the ink droplet 100 has already permeated into the image receiving layer and the coloring material (solute) has been retained in this layer, there will be virtually no change in the shape of the dot 102 within the image receiving layer.

Figure 11:
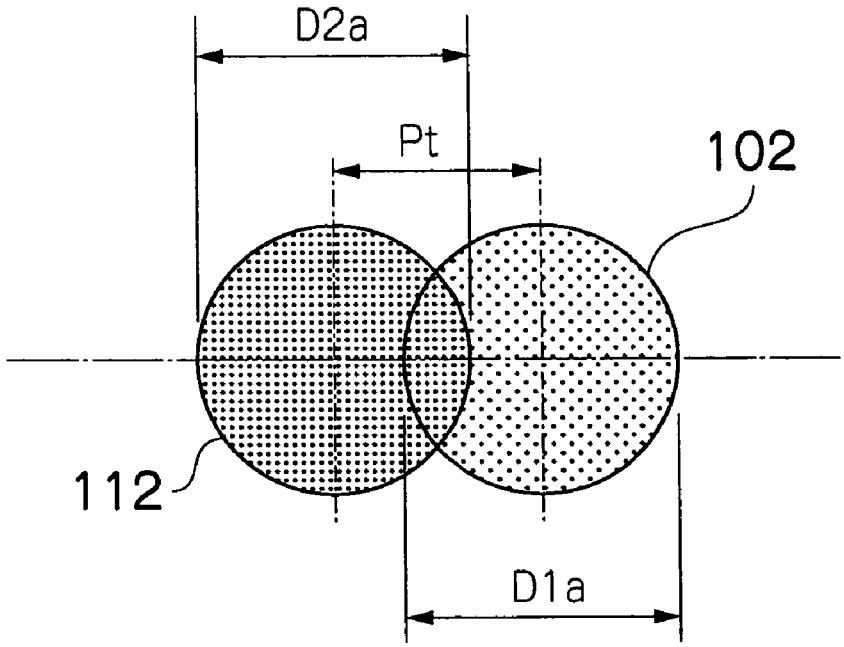
FIG. 11 is a diagram for describing the results of the droplet ejection control illustrated in FIG. 7.

When the aforementioned complete permeation time T has elapsed since the ink droplet 110 landed on the recording paper 16, the ink droplet 110 will have permeated completely into the recording paper 16, and the dot 102 of diameter D1*a* and the dot 112 of diameter D2*a* will have been formed, as shown in FIG. 11.

Figure 12:
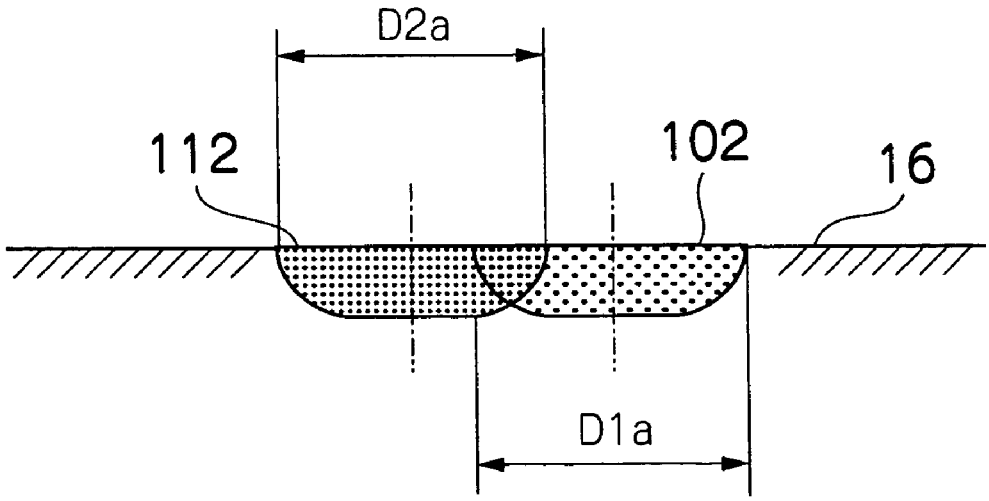
FIG. 12 is a cross-sectional view of FIG. 11.

FIG. 12 is a cross-sectional diagram showing a cross-section of the dot 102 and the dot 112 illustrated in FIG. 11.

Therefore, when two dots are to overlap, after depositing a first ink droplet, it is possible to deposit the succeeding ink droplet without having to wait for the complete permeation time T, which is the time period until the previously deposited ink droplet has permeated completely into the paper. Namely, the succeeding ink droplet can be ejected while D1*b* is still greater than 0.

In other words, the value of the diameter D1*b* of the ink droplet 100 that will satisfy the above-described Formula 1 when the ink droplet 110 lands on the paper, is determined from the interval Pt between the preceding ink droplet 100 and the succeeding ink droplet 110 and the diameter D2*a* of the ink droplet 110 upon landing. The diameter D1*b* of the ink droplet 100 thus determined, and the diameter D1a of the ink droplet 100 upon landing on the paper, are used to calculate the permeation time δT. The droplet ejection timing for the ink droplet 100 and the ink droplet 110 is controlled by taking the permeation time δT thus determined as the droplet ejection interval.

The embodiment has been described above with respect to a dye-based ink wherein the coloring material is retained by the permeation in the image receiving layer of the recording paper 16 to which the ink is permeable; however, the present invention may also be applied to the case where pigment-based ink wherein the majority of the coloring material solidifies on the surface of the recording paper 16 or ultraviolet curable ink is deposited on the surface of the recording paper 16 to which the ink is not permeable.

If the coloring material in the ink has a large molecular structure and is mixed in with a solvent without being dissolved in the solvent (as in the case of many pigment-based inks), then when an ink droplet lands on the surface of the recording paper 16, the solvent permeates into the image receiving layer and a portion of the coloring material also permeates into the image receiving layer. However, the majority of the coloring material solidifies on the surface of the paper. Also in the case of the ultraviolet curable ink, the majority of the ink droplet deposited on the surface of the recording paper 16 solidifies (cures) on the surface of the recording paper 16 by being irradiated with ultraviolet light.

In this case, the portion of the ink deposited on the recording paper 16 existing as the droplet becomes small from the outer side towards the inner side as the solidification (curing) advances. Therefore, the present invention can be applied in order to prevent respective ink droplets from mixing together on the surface of the recording paper 16.

Figure 13:
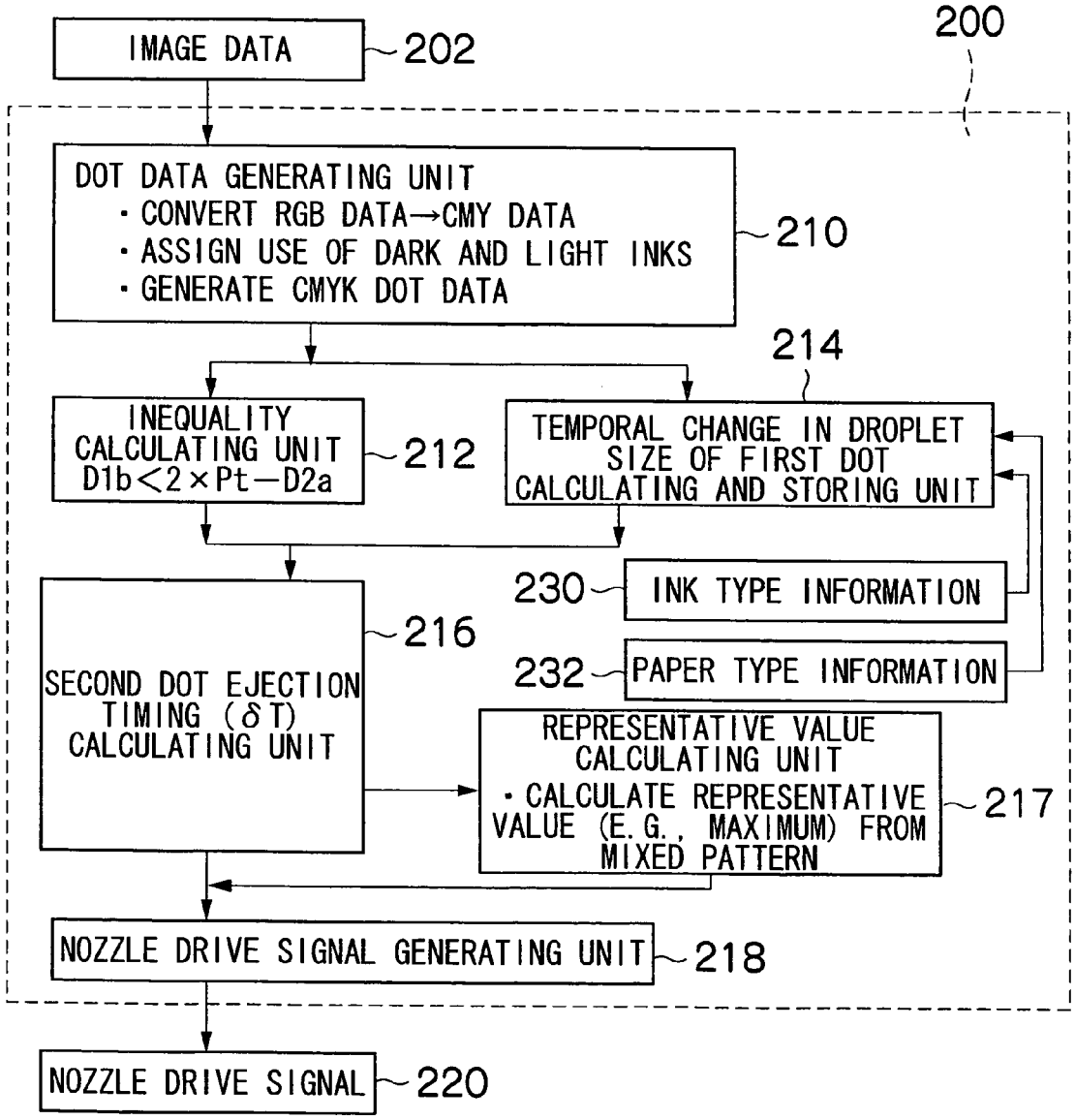
FIG. 13 is a block diagram of a droplet ejection control unit in an inkjet recording apparatus relating to an embodiment of the present invention.

FIG. 13 is a block diagram showing the detailed composition of a droplet ejection controller 200 for executing the droplet ejection control described above. The droplet ejection controller 200 is contained in the system (the print controller 80) shown in FIG. 6.

When image data 202 is obtained from the host computer 86 shown in FIG. 6, a dot data generating unit 210 performs processing for converting the RGB data into CMY data, allocating use of dark and light inks, and generating CMYK dot data.

Thereupon, an inequality calculating unit 212 determines the diameter D1*b* of the preceding ink droplet (the ink droplet 100 in FIG. 11), according to the pitch Pt between the two dots (for example, the pitch between the ink droplet 100 and the ink droplet 110 shown in FIG. 11), and the diameter D2*a* of the succeeding ink droplet (the ink droplet 110 in FIG. 11).

Information relating to temporal change in the size of the ink droplets is stored in a dot size calculating and storing unit 214. By referring to this information, a timing calculating unit 216 determines the permeation time δT until the aforementioned value of D1*b* is reached, from the diameter D1*a* of the preceding ink droplet upon landing on the paper. In other words, the timing calculating unit 216 determines the droplet ejection interval δT. Furthermore, the timing control parameters in the sub-scanning direction (such as the recording paper conveyance speed), and the timing control parameters in the main scanning direction (such as the interval L between the print head 50A and the print head 50B) are determined from this permeation time value δT.

In a case of a mixed pattern in which there are dots of different diameters, a representative value calculating unit 217 calculates the representative value of the permeation times δT, the representative value of the timing control parameters in the sub-scanning direction (such as the recording paper conveyance speed), and the representative value of the timing control parameters in the main scanning direction (such as the interval L between the print head 50A and the print head 50B), and the like in the mixed pattern. The representative values may be the maximums of the permeation times δT, the timing control parameters in the sub-scanning direction, and the timing control parameters in the main scanning direction, respectively, or may be the minimums, the averages, the most frequent values, or the like of them.

A drive signal 220 for the nozzles is generated by a nozzle drive signal generating unit 218, according to the permeation time δT, and the timing control parameters relating to the sub-scanning direction and the main scanning direction determined in this manner.

Here, the speed at which the ink droplet permeates into the recording paper 16 is determined principally by the type of ink, the type of recording paper 16, the ambient temperature, the humidity, and the like.

The dot size calculating and storing unit 214 stores this various information in the form of a data table, and it calculates the parameters used to derive the permeation time δT and supplies these to the timing calculating unit 216.

Values for the diameter D1*b* may also be calculated in advance, from the aforementioned diameter D1*a*, the diameter D2*a* and the dot interval Pt, and registered in a database. The permeation time δT can then be determined by referring to the data relating to the diameter D1*b* contained in this database. The database may be provided inside the inkjet recording apparatus 10, or it may be provided externally.

Ink type information 230 may be read in and stored when an ink cartridge is installed, and this information may then be supplied to the timing calculating unit 216 when printing is carried out. Similarly, paper type information 232 may be read in and stored when the recording paper 16 is loaded.

The ink type information 230 and the paper type information may be read in automatically from a wireless tag or barcode attached to the ink cartridge, paper tray, or the like, when the cartridge or tray is installed. Alternatively, this information may be input by an operator, via a keyboard or touch panel.

The temporal change in the diameter of the ink droplet for respective ink types and paper types is now described with reference to FIG. 14 and FIG. 15.

Figure 14:
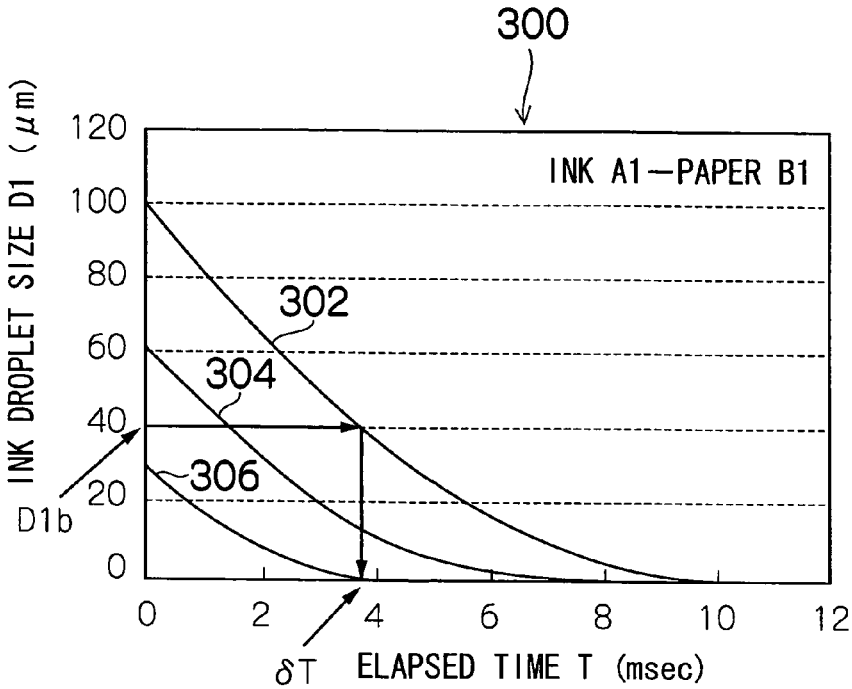
FIG. 14 is a graph showing the relationship between the time elapsed after landing, and the diameter of the ink droplet.

FIG. 14 is a graph 300 showing the change in ink droplet size over time, in a case where ink A1 and paper B1 are used. In the graph 300, curve 302 indicates a case where the ink droplet has a size of 100 μm upon landing on the paper, and curves 304 and 306 respectively indicate cases where the ink droplet has a size of 60 μm and 30 μm upon landing on the paper.

For example, from the curve 302, it can be seen that the time taken for the size of the ink droplet to reduce from 100 μm at landing, to 40 μm, is approximately 3.9 milliseconds (msec). On the other hand, curve 304 shows that the time taken for the ink droplet size to reduce from 60 μm at landing, to 0 μm, (in other words, the time until complete permeation), is 7.0 msec. Thus, although the amount of change in the droplet size is the same as that in the case indicated by curve 302, namely 60 μm, the time required for this change to take place is different, due to the different size of the ink droplet when it lands on the paper.

Therefore, desirably, graph 300 also includes curves for other values of the droplet size upon landing, in addition to curves 302, 304 and 306.

Figure 15:
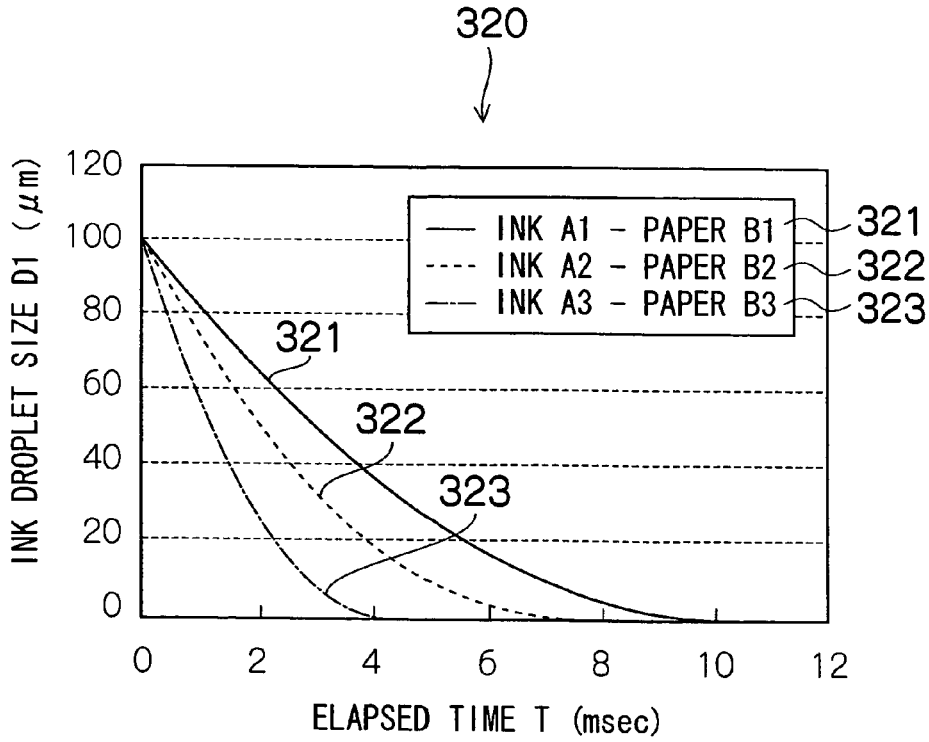
FIG. 15 shows a modification of the graph illustrated in FIG. 14.

FIG. 15 is a graph 320 showing the change over time in the ink droplet size for three types of ink and paper, in the case of a droplet size upon landing of 100 μm. In the graph 320, curve 321 relates to a combination of ink A1 and paper B1, curve 322 relates to a combination of ink A2 and paper B2, and curve 323 relates to a combination of ink A3 and paper B3.

In this way, the time required for a change in the ink droplet size corresponding to the permeation of the ink droplet into the image receiving layer of the recording paper 16 to which ink is permeable or the solidification (curing) of the ink droplet on the recording paper 16 to which ink is not permeable, after landing on the recording paper (in other words, the permeation, solidification, or curing time δT) is determined previously by experimentation, simulation, or the like, for a plurality of combinations of ink types and paper types. These time values are stored in the dot size calculating and storing unit 214.

Here, the time values may be recorded in the form of a graph (using equations based on an approximation for each curve), but desirably, each of the curves is stored in the form of a data table.

It is also possible to store representative values corresponding to various conditions relating to ambient temperature, humidity, and the like, besides the ink type and paper type, in such a manner that values corresponding to the actual ambient conditions can be derived by interpolation.

Moreover, if a type of ink or paper for which no data has been stored is loaded into the printer, then an imaging device, or the like, may be used to capture and measure an actual ink droplet deposited onto the paper, in order that the corresponding permeation time δT can be determined. A line sensor, area sensor, or the like, is preferably used in the imaging device. The print determination unit 24 illustrated in FIG. 1 may be used as this imaging device.

Figure 16:
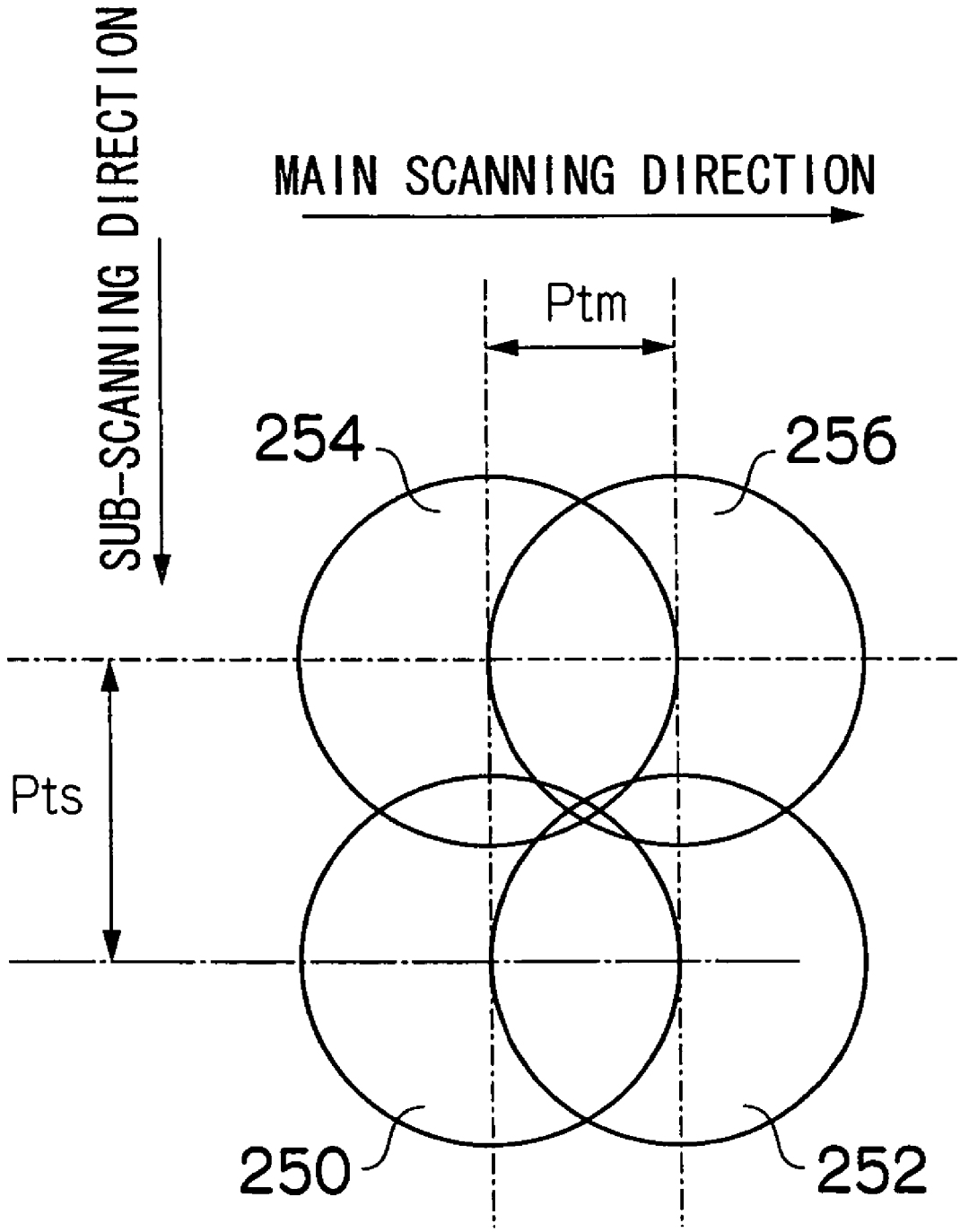
FIG. 16 is a diagram for describing the main scanning direction, the sub-scanning direction, and the droplet ejection interval.

In the present embodiment, if necessary, it is also possible to handle the dot pitch Pts in the sub-scanning direction (the recording paper conveyance direction), separately from the dot pitch Ptm in the main scanning substantially orthogonal to the recording paper conveyance direction, as shown in FIG. 16. Thus, the droplet ejection timing relating to δT, as determined according to the value of D1*b* obtained from the above-described Formula 1, can also be handled separately in terms of a droplet ejection interval δTm in the main scanning direction and a droplet ejection interval δTs in the sub-scanning direction.

Furthermore, the present invention can also be applied to the droplet ejection timing for dots which are adjacent in an oblique direction, rather than in the main scanning direction or sub-scanning direction, such as dot 250 and dot 256 in FIG. 16.

As illustrated in FIG. 3A, the inkjet recording apparatus 10 has the print head 50A and the print head 50B aligned in the sub-scanning direction, and the interval L between the print head 50A and the print head 50B is variable. Therefore, it is also possible to control the droplet ejection interval δTm between dots that are adjacent in the main scanning direction in the line head, by adjusting the interval L between the print head 50A and the print head 50B and the conveyance speed of the recording paper 16.

In other words, if a dot 250 has been ejected by the print head 50A and a dot 252 adjacent to the dot 250 is to be ejected from the print head 50B, then the droplet ejection interval δTm in the main scanning direction is determined from the conveyance speed Vs of the recording paper 16 and the distance L between the print head 50A and the print head 50B, by means of the following Formula 2:

$$\delta Tm = L/Vs. \quad (2)$$

On the other hand, the droplet ejection interval δTs in the sub-scanning direction is determined from the recording paper conveyance speed Vs and the droplet ejection interval Pts in the sub-scanning direction, by means of the following Formula 3:

$$\delta Ts = Pts/Vs. \quad (3)$$

The foregoing examples have been described with reference to the full line head, but the present invention may also be applied to a serial head (shuttle scan type head). In the serial head, there are two rows of nozzles in the sub-scanning direction, where the distance between the center lines of the two rows is defined as Ls. One nozzle row is displaced by half a pitch with respect to the other nozzle row, thereby forming a staggered matrix arrangement of nozzles. The interval between the nozzle rows can be changed.

The droplet ejection interval δTm in the main scanning direction is determined from the speed of the print head in the main scanning direction (the scanning speed) Vm and the dot pitch Ptm in the main scanning direction, by means of the following Formula 4:

$$\delta Tm = Ptm/Vm. \quad (4)$$

The dot 252 is ejected with respect to the dot 250, and similarly, the dot 256 is ejected with respect to the dot 254, in such a manner that the Formula 4 is satisfied in either case.

Similarly, the droplet ejection interval δTs in the sub-scanning direction is determined from the recording paper conveyance speed Vs and the interval between nozzle rows Ls in the sub-scanning direction, by means of the following Formula 5:

$$\delta Ts = Ls/Vs. \quad (5)$$

The dot 254 is ejected with respect to the dot 250, and similarly, the dot 256 is ejected with respect to the dot 252, in such a manner that the Formula 5 is satisfied in either case.

The present invention may also be applied to cases where mixed patterns combining different dot pitches and dot sizes are used in one image. In mixed patterns of this kind, the control operation can be simplified, by firstly determining the droplet ejection interval δTm in the main scanning direction and the droplet ejection interval δTs in the sub-scanning direction, respectively, for all of the combination of dot pitches and dot sizes, and then using maximum values of these droplet ejection intervals δTm and δTs, namely, δTmax-m and δTmax-s, as representative droplet ejection intervals for that image.

In other words, the droplet ejection intervals for the image are set in accordance with the pattern having the largest droplet ejection interval in the image. The reference value is taken to be the droplet ejection timing for the ink droplets in the overlapping region that is most liable to cause blurring, and the other areas of the image are set to the same droplet ejection timing.

Moreover, it is also possible to allow a safety margin and set the droplet ejection intervals for the image to values greater than the maximum values, δTmax-m and δTmax-s.

Figure 17:
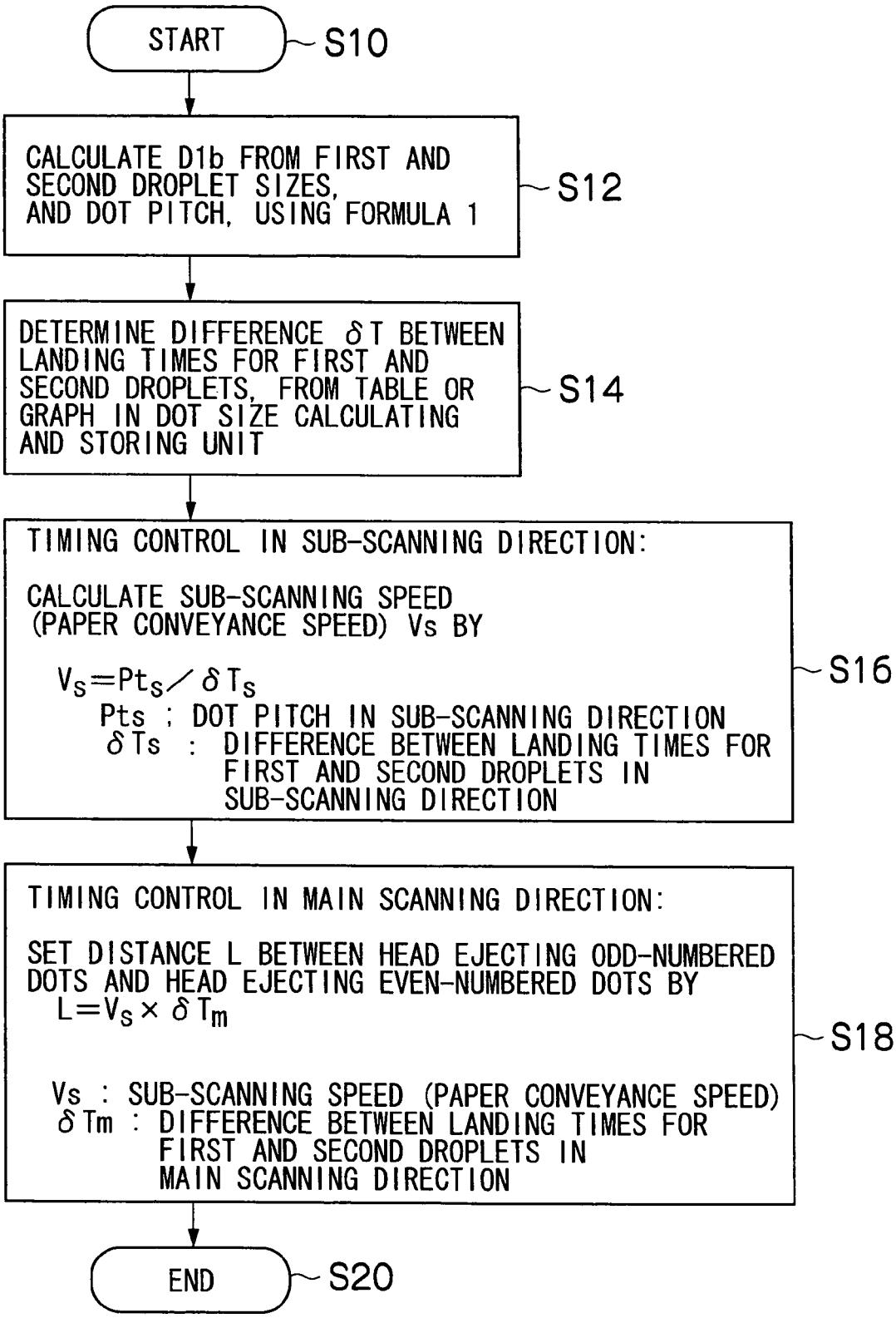
FIG. 17 is a flowchart showing the sequence of droplet ejection control in the inkjet recording apparatus according to the present invention.

FIG. 17 is a flowchart showing the sequence of the droplet ejection timing control described above.

When image data is inputted and print control is started (step S10), the Formula 1 is used to calculate the diameter D1*b* of the ink droplet 100 forming the first dot 102 (for example, the dot 102 in FIG. 11), according to the dot pitch Pt between the first dot and the second dot (for example, the dot 112 in FIG. 11), and the diameter D2*a* of the second dot (step S12 in FIG. 17).

Thereupon, the permeation time δT, which indicates the difference between the landing times for the first droplet and the second droplet, is determined according to the diameter D1*a* upon landing of the ink droplet 100 forming the first dot (the preceding ink droplet) and the value of D1*b* determined at step S12 (step S14). Here, the value of δT is determined in accordance with the ink type and the paper type by referring to the data tables and graphs 300 and 320 stored in the dot size calculating and storing unit 214 shown in FIG. 13.

Then, timing control in the sub-scanning direction is executed. When the permeation time δT has been determined, the timing calculation section 216 shown in FIG. 13 works out the speed in the sub-scanning direction (the recording paper conveyance speed) Vs according to the Formula 3 (step S16).

Thereupon, timing control in the main scanning direction is executed. The interval L between the print head 50A and the print head 50B shown in FIG. 16 is derived from the Formula 2, and the interval is adjusted to the derived value (step S18).

When an image has been formed while executing the timing control for the sub-scanning direction and main scanning direction in this manner, the printing control sequence terminates (step S20).

The interval L between the print head 50A and the print head 50B may be increased slightly to allow a surplus distance, and the conveyance speed of the recording paper may be changed according to the type of ink or type of paper used.

The present invention can be applied to cases where a dot formed by a subsequently ejected ink droplet (the dot 112 in FIG. 11) overlaps with less than one half of a dot formed by a previously ejected ink droplet (the dot 102 in FIG. 11). In other words, it can be applied to cases satisfying the following Formula 6:

$$D2a/2 < Pt. \quad (6)$$

A program (software) for implementing the droplet ejection control described above can be created, and this program can be installed in the inkjet recording apparatus 10. Moreover, the program can be recorded onto a recording medium (such as a magnetic or optical recording medium) to be distributed and installed in an inkjet recording which can use the recording medium. Furthermore, the program can also be distributed through networks such as the Internet to be installed in an inkjet recording apparatus.

In the inkjet recording apparatus 10 having the aforementioned composition, if overlapping dots are to be formed, then a value is determined for the diameter D1*b* of a previously ejected ink droplet at which this ink droplet will not combine with a subsequently ejected ink droplet on the surface of the recording paper 16. This value of D1*b* is determined from the dot pitch Pt and the diameter D2*a* of the subsequently ejected ink droplet when it lands on the paper.

Moreover, the permeation time δT taken for the size of the preceding ink droplet to reduce from D1*a* upon landing, to D1*b* , is determined, and droplet ejection is controlled by taking this permeation time δT as the droplet ejection interval between the preceding ink droplet and the succeeding ink droplet.

The succeeding droplet can be ejected without waiting for the complete permeation time T, which is the time taken for the previously ejected ink droplet to permeate completely into the recording paper 16. Therefore, the printing time can be reduced. Furthermore, since the preceding ink droplet and the succeeding ink droplet do not combine on the surface of the recording paper 16, and furthermore, since the preceding ink droplet and the succeeding ink droplet do not combine in the image receiving layer of the recording paper 16 either, then the dot size is not disturbed and the desired dot shape can be obtained.

The droplet ejection interval is dependent on the ink type, the paper type, and ambient conditions, such as temperature and humidity. Therefore, it is calculated in accordance with these conditions. Furthermore, the droplet ejection interval can be determined respectively for both the main scanning direction and the sub-scanning direction, in such a manner that droplet ejection is controlled respectively in the main scanning direction and sub-scanning direction. Therefore, a line head or a serial head may be used as the print head.

In mixed patterns comprising different dot sizes and dot pitches, the droplet ejection interval may be determined for each respective pattern, the maximum value of the droplet ejection interval being taken as the droplet ejection interval for that image. A safety margin may be added to this maximum value.

The inkjet recording apparatus has been described in the above-described embodiments as one example of an image forming apparatus, but the range of application of the present invention is not limited to this. The present invention may also be applied to liquid ejecting apparatuses in general, such as dispensers or coating apparatuses, which eject a liquid, such as water, liquid chemical, or processing liquid, onto an ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a recording head which ejects droplets of a liquid onto a recording medium;

a droplet ejection control device which controls a droplet ejection timing of the recording head; and a conveyance device which relatively moves the recording medium and the recording head in a relative conveyance direction, wherein when the recording head performs ejection of a first droplet to form a first dot on the recording medium and then performs ejection of a second droplet to form a second dot overlapping with the first dot on the recording medium, the droplet ejection control device controls the droplet ejection timing of the recording head by taking a droplet diameter change time until a diameter of the first droplet deposited on a surface of the recording medium reaches D1*b* satisfying the following inequality as a droplet ejection time interval between the ejection of the first droplet and the ejection of the second droplet:

$$D1b<2\times Pt-D2a,$$

where Pt is an interval between the first dot and the second dot on the surface of the recording medium, D2*a* is a diameter of the second droplet upon landing on the surface of the recording medium, and D1*b* is the diameter of the first droplet on the surface of the recording medium when the second droplet lands on the surface of the recording medium.

2. The image forming apparatus as defined in claim 1, wherein the droplet ejection control device controls the droplet ejection timing by means of one droplet ejection time interval within one image.

3. The image forming apparatus as defined in claim 1, wherein the recording head is a line head in which a plurality of nozzles are arranged over a length corresponding to a full width of the recording medium.

4. The image forming apparatus as defined in claim 3, wherein:

the recording head comprises a first nozzle row having nozzles for ejecting droplets forming odd-numbered dots of dots formed in a direction substantially orthogonal to the relative conveyance direction, and a second nozzle row having nozzles for ejecting droplets forming even-numbered dots of the dots; and the image forming apparatus further comprises an interval changing device which changes an interval between the first nozzle row and the second nozzle row according to the droplet ejection control in the relative conveyance direction.

5. The image forming apparatus as defined in claim 1, wherein the recording head is a serial head in which a plurality of nozzles are arranged over a length shorter than a full width of the recording medium, and the recording head comprises a moving device which relatively moves the recording head and the recording medium in a direction in which the plurality of nozzles are arranged.

6. The image forming apparatus as defined in claim 5, wherein:

the recording head comprises a first nozzle row having nozzles for ejecting droplets forming odd-numbered dots of dots formed in a direction substantially orthogonal to the relative conveyance direction, and a second nozzle row having nozzles for ejecting droplets forming even-numbered dots of the dots; and the image forming apparatus further comprises an interval changing device which changes an interval between the first nozzle row and the second nozzle row according to the droplet ejection control in the direction substantially orthogonal to the relative conveyance direction.

7. The image forming apparatus as defined in claim 1, further comprising:

a droplet ejection condition calculating device which determines the diameter D1*b* of the first droplet satisfying the inequality:

$$D1b<2\times Pt-D2a,$$

with respect to the interval Pt between the first dot and the second dot on the surface of the recording medium, and the diameter D2*a* of the second droplet upon landing on the surface of the recording medium; and a droplet diameter change time calculating device which determines the droplet diameter change time from a time at which the first droplet lands on the surface of the recording medium until the diameter of the first droplet on the surface of the recording medium reaches D1*b*.

8. The image forming defined in claim 7, further comprising:

an information supply device which supplies information containing at least one of information relating to a type of the liquid and information relating to a type of the recording medium, wherein the droplet diameter change time calculating device calculates the droplet diameter change time according to the information supplied by the information supply device.

9. The image forming apparatus as defined in claim 7, wherein:

the droplet diameter change time calculating device determines a first droplet conveyance direction, and a second droplet diameter change time in a sub-scanning direction being the relative conveyance direction, according to the interval between the first dot and the second dot in the main scanning direction, and the interval between the first dot and the second dot in the sub-scanning direction; and the droplet ejection control device controls the droplet ejection timing by taking the first droplet diameter change time and the second droplet diameter change time as a droplet ejection time interval in the main scanning direction and a droplet ejection time interval in the sub-scanning direction, respectively.

10. The image forming apparatus as defined in claim 7, wherein when a mixed pattern including a plurality of combinations of the interval between the first dot and the second dot, the first dot diameter and the second dot diameter, is to be formed within one image on the recording medium, the droplet diameter change time calculating device calculates a plurality of values for the droplet diameter change time, and the droplet ejection control device controls a recording timing for the image by using a representative value of the plurality of droplet ejection diameter change time values.

11. The image forming apparatus defined in claim 10, wherein the representative value of the droplet diameter change time includes at least a value not less than a maximum value of the plurality of droplet diameter change time values calculated by the droplet diameter change time calculating device.

* * * * *